US010472212B1

(12) United States Patent
Keisler

(10) Patent No.: US 10,472,212 B1
(45) Date of Patent: Nov. 12, 2019

(54) PIPE LIFTING ASSEMBLY

(71) Applicant: John Keisler, Aurora, CO (US)

(72) Inventor: John Keisler, Aurora, CO (US)

( * ) Notice: Subject to any disclaimer, the term of this patent is extended or adjusted under 35 U.S.C. 154(b) by 0 days.

(21) Appl. No.: 16/218,621

(22) Filed: Dec. 13, 2018

(51) Int. Cl.
*B66C 1/56* (2006.01)

(52) U.S. Cl.
CPC ..... *B66C 1/56* (2013.01)

(58) Field of Classification Search
CPC .. B66C 1/54; B66C 1/56; B66C 1/422; B66C 1/442; B25J 15/0047
USPC ..... 294/86.24, 97
See application file for complete search history.

(56) References Cited

U.S. PATENT DOCUMENTS 1,477,687 A * 12/1923 Brown ..... B21C 47/30 242/362.3
1,804,843 A * 5/1931 Santiago ..... B25B 27/023 254/30
2,386,034 A * 10/1945 Church ..... B29D 30/02 294/97
2,613,983 A * 10/1952 Knudsen ..... B25B 27/06 29/262
2,687,324 A 8/1954 Grunsky
2,778,671 A 1/1957 Langston
2,823,948 A * 2/1958 Horton ..... B66C 1/54 294/97
2,879,101 A * 3/1959 Daroci ..... B25B 27/02 254/29 R
3,033,605 A * 5/1962 Morrow, Jr. ..... B29D 30/0016 294/115
3,519,304 A * 7/1970 Shores ..... B25B 9/00 294/97
3,892,437 A 7/1975 Makinen
4,095,834 A * 6/1978 Strauss ..... B66C 1/54 294/97
4,235,469 A 11/1980 Denny
4,500,078 A * 2/1985 Brennan ..... B66C 1/56 269/238
5,490,702 A * 2/1996 Fleming ..... B66C 1/54 294/62
7,232,167 B2 6/2007 Edwards
D548,579 S 8/2007 Gaudron
8,894,115 B2 11/2014 Lundman

FOREIGN PATENT DOCUMENTS

GB 2 080 243 * 2/1982

* cited by examiner

*Primary Examiner* — Dean J Kramer

(57) ABSTRACT

A pipe lifting assembly includes an eyebolt that is insertable into a pipe. A pair of spreaders is provided and each of the spreaders is slidably positioned around the eyebolt. Each of the spreaders is positionable at a selected point along the eyebolt, and the pair of spreaders includes an upper spreader and a lower spreader. A plurality of grips is each pivotally coupled between each of the spreader. Each of the grips is spaceable a selected distance from the eyebolt when the upper spreader is moved upwardly or downwardly along the eyebolt. Additionally, each of the grips frictionally engages an interior surface of the pipe when the eyebolt is positioned in the pipe and the upper spreader is moved downwardly along the eyebolt. In this way each of the grips facilitate the pipe to be lifted when the eyebolt is lifted.

5 Claims, 6 Drawing Sheets

PIPE LIFTING ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to lifting devices and more particularly pertains to a new lifting device for lifting pipes and other tubular objects.

BRIEF SUMMARY OF THE INVENTION

An embodiment of the disclosure meets the needs presented above by generally comprising an eyebolt that is insertable into a pipe. A pair of spreaders is provided and each of the spreaders is slidably positioned around the eyebolt. Each of the spreaders is positionable at a selected point along the eyebolt, and the pair of spreaders includes an upper spreader and a lower spreader. A plurality of grips is each pivotally coupled between each of the spreader. Each of the grips is spaceable a selected distance from the eyebolt when the upper spreader is moved upwardly or downwardly along the eyebolt. Additionally, each of the grips frictionally engages an interior surface of the pipe when the eyebolt is positioned in the pipe and the upper spreader is moved downwardly along the eyebolt. In this way each of the grips facilitate the pipe to be lifted when the eyebolt is lifted.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
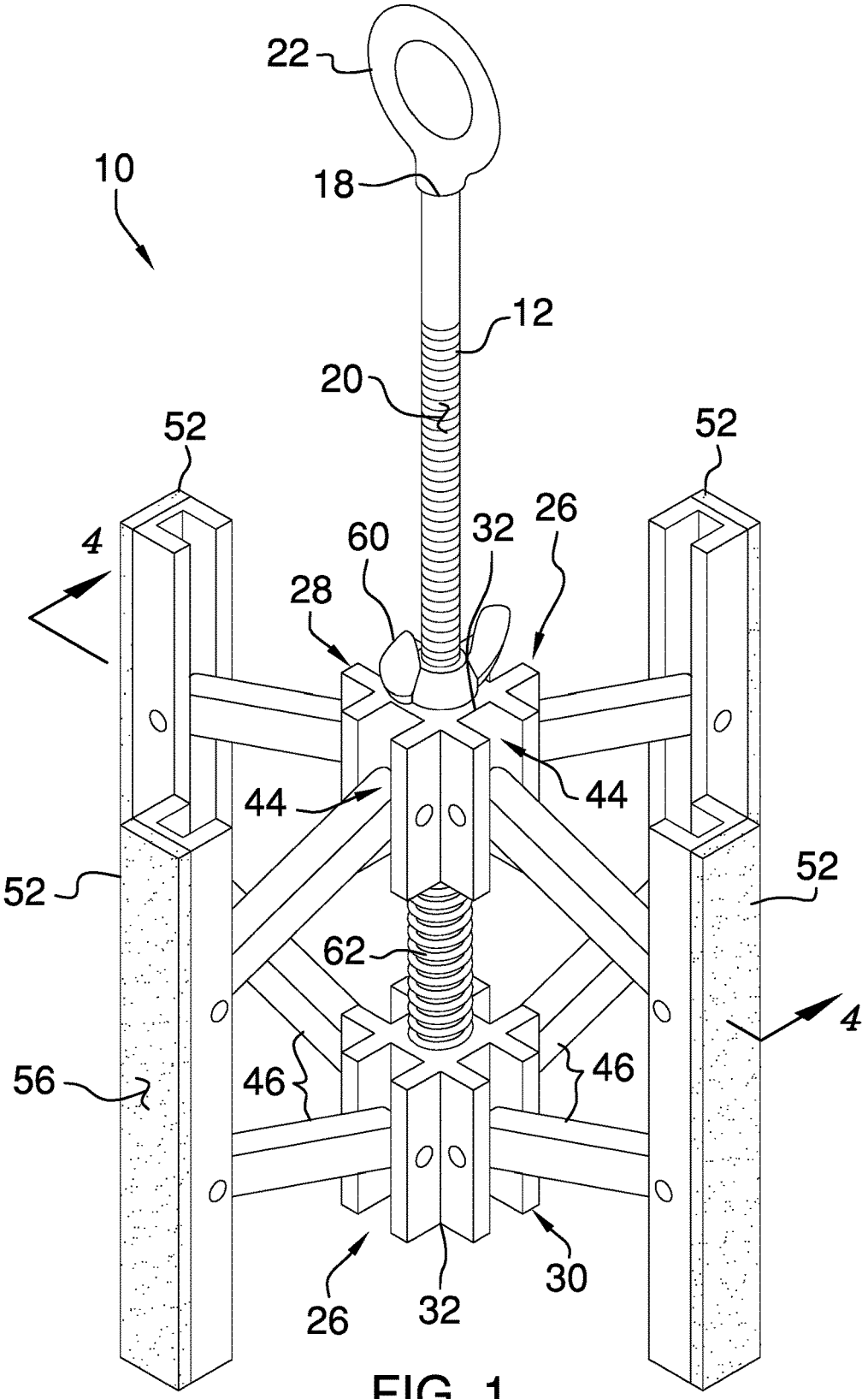
FIG. 1 is a perspective view of a pipe lifting assembly according to an embodiment of the disclosure.

With reference now to the drawings, and in particular to FIGS. 1 through 7 thereof, a new lifting device embodying the principles and concepts of an embodiment of the disclosure and generally designated by the reference numeral 10 will be described.

As best illustrated in FIGS. 1 through 7, the pipe lifting assembly 10 generally comprises an eyebolt 12 that is insertable into a pipe 14. The pipe 14 may be a steel pipe or the like with an inside diameter ranging between approximately 4.0 inches and 12.0 inches. Additionally, the pipe 14 may be any tubular object that is too heavy to be lifted by hand. The eyebolt 12 has a first end 16, a second 18 and an outer surface 20 extending therebetween, and the outer surface 20 is threaded. The eyebolt 12 has a length of at least 11.0 inches and an eye 22 of the eyebolt 12 is positioned on the second end 18. A cap 24 is coupled to the first end 16 of the eyebolt 12 and the cap 24 has an outside diameter that is greater than an outside diameter of the eyebolt 12. In this way the cap 24 acts as a stop on the first end 16 of the eyebolt 12.

A pair of spreaders 26 is each slidably positioned around the eyebolt 12, and each of the spreaders 26 is positionable at a selected point along the eyebolt 12. The pair of spreaders 26 includes an upper spreader 28 and a lower spreader 30. The lower spreader 30 rests on the cap 24 such that the lower spreader 30 is inhibited from passing downwardly beyond the cap 24. The upper spreader 28 is positioned between the lower spreader 30 and the eye 22 on the eyebolt 12.

Each of the spreaders 26 comprises a block 32 that has a top end 34, a bottom end 36 and an outer surface 38 extending therebetween. The block 32 has an aperture 40 extending through the top 34 and bottom 36 ends, and the eyebolt 12 extends through the aperture 40 such that the block 32 is slidable on the eyebolt 12. The bottom end 36 of the block 32 of the lower spreader 30 abuts the cap 24. The outer surface 38 has a plurality of intersecting sides 42, and each of the intersecting sides 42 has a coupling 44 that is attached thereto. The coupling 44 may be defined by a channel that extends into outer surface 20, an eyelet or any other structure that is capable of receiving a pivoting attachment.

Each of the spreaders 26 includes a plurality of arms 46 that each has a primary end 48 and a secondary end 50. The primary end 48 of each of the arms 46 is pivotally coupled to the coupling 44 on a respective one of the intersecting sides 42 of the outer surface 38 of the block 32. Thus, each of the arms 46 is positionable an upward or downward angle on the block 32. A plurality of grips 52 is each pivotally coupled between each of the spreaders 26 and each of the grips 52 is oriented collinear with the eyebolt 12. Each of the grips 52 is spaceable a selected distance from the eyebolt 12 when the upper spreader 28 is moved upwardly or downwardly along the eyebolt 12.

Each of the grips 52 frictionally engages an interior surface 54 of the pipe 14 when the eyebolt 12 is positioned in the pipe 14 and the upper spreader 28 is moved downwardly along the eyebolt 12. In this way the grips 52 facilitate the pipe 14 to be lifted when the eyebolt 12 is lifted. Moreover, the pipe 14 can be lifted without employing slings or straps wrapped around the pipe 14. Thus, the pipe 14 can be maneuvered without the risk of slipping out of the slings or straps thereby enhancing safety for nearby individuals. Each of the grips 52 disengages the interior surface 54 of the pipe 14 when the upper spreader 28 is moved upwardly along the eyebolt 12. Thus, the eyebolt 12, the spreader and the grips 52 can be removed from the pipe 14.

Each of the grips 52 has a first surface 56 and a second surface 58. The secondary end 50 of each of the arms 46 is pivotally coupled to the second surface 58 of a respective one of the grips 52. The first surface 56 of each of the grips 52 comprises an abrasive material, thereby enhancing the ability of the first surface 56 of each of the grips 52 to frictionally engage the interior surface 54 of the pipe 14.

A nut 60 threadably engages the eyebolt 12 and the nut 60 can rotatably travel upwardly and downwardly along the eyebolt 12. The nut 60 is positioned between the upper spreader 28 and the eye of the eyebolt 12. The nut 60 urges the upper spreader 28 toward the lower spreader 30 when the nut 60 is tightened on the eyebolt 12. Moreover, the nut 60 engages the top end 34 of the block 32 of the upper spreader 28 when the nut 60 is tightened.

Figure 2:
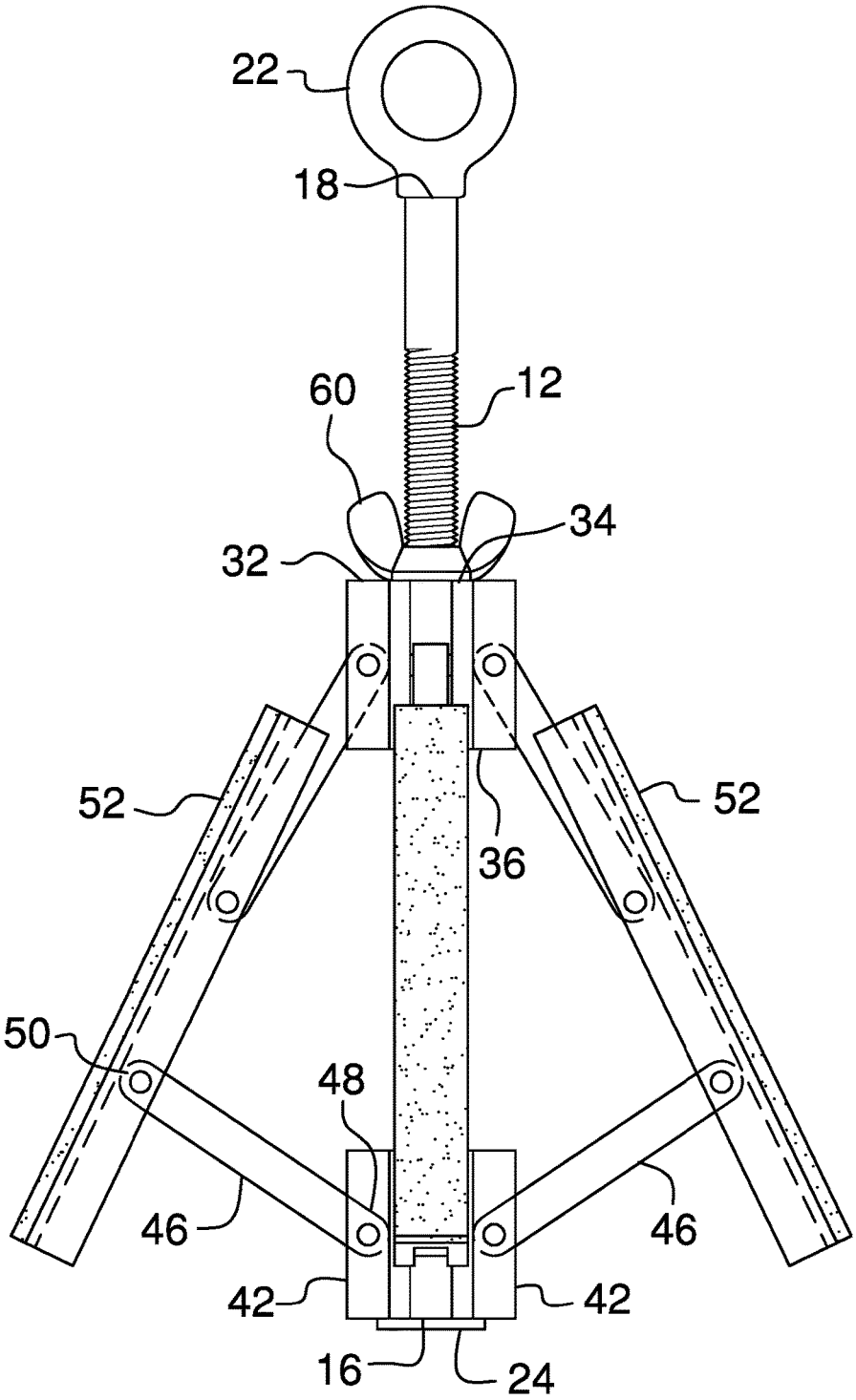
FIG. 2 is a front view of an embodiment of the disclosure.
Figure 3:
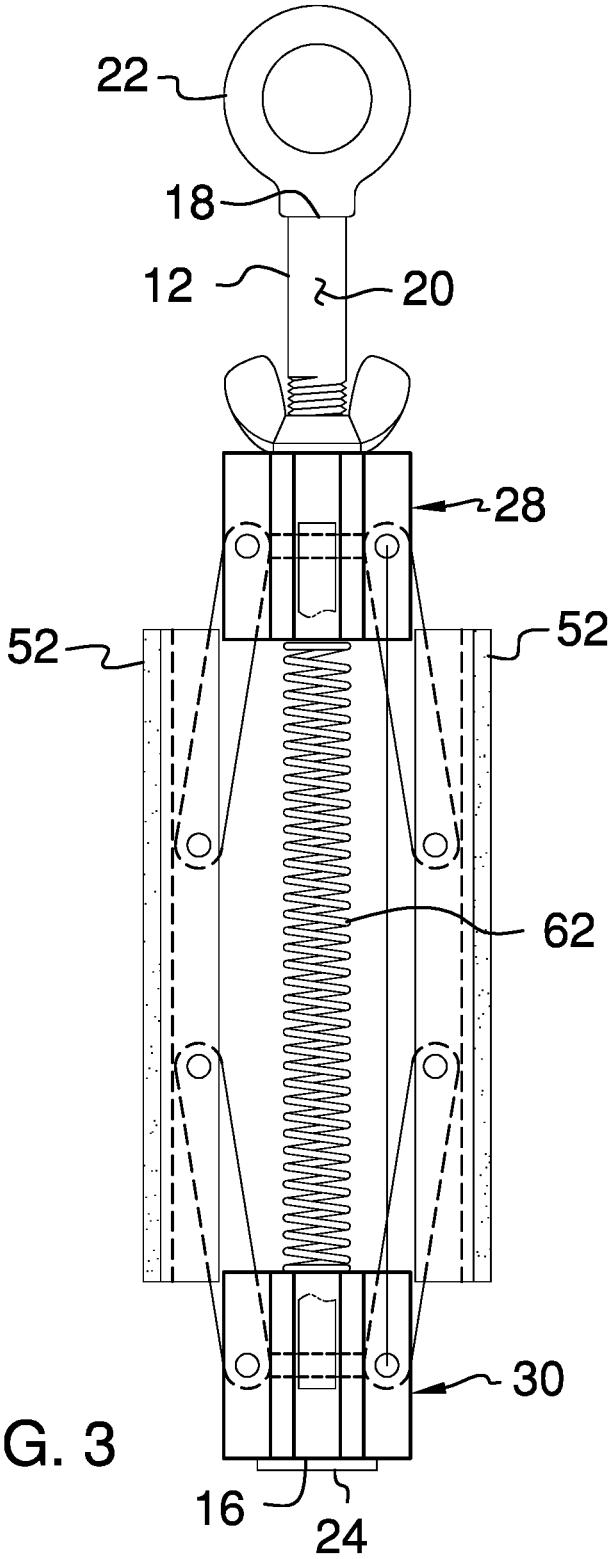
FIG. 3 is a back view of an embodiment of the disclosure.
Figure 4:
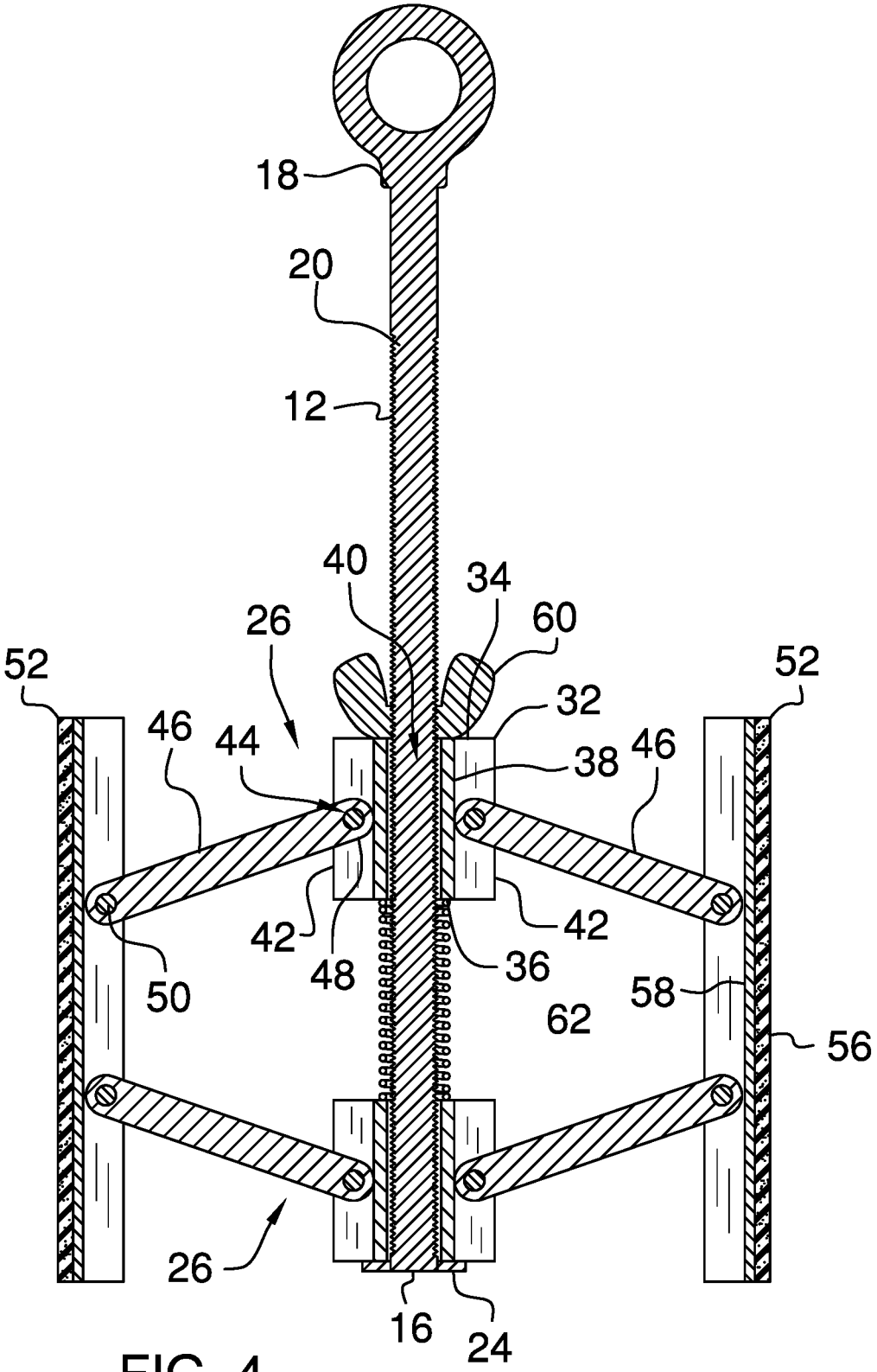
FIG. 4 is a cross sectional view taken along line 4-4 of FIG. 1 of an embodiment of the disclosure.
Figure 5:
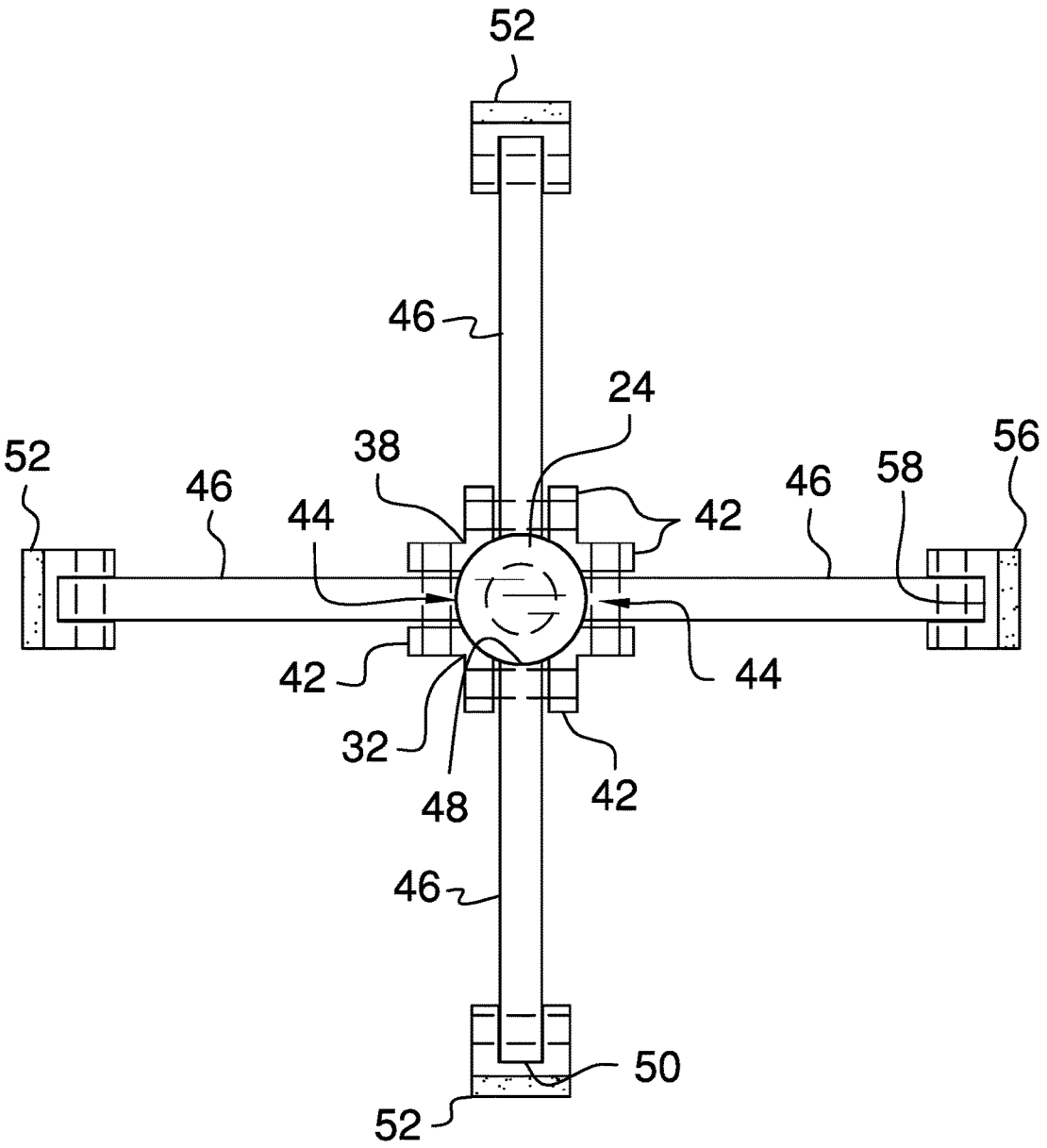
FIG. 5 is a bottom view of an embodiment of the disclosure.
Figure 6:
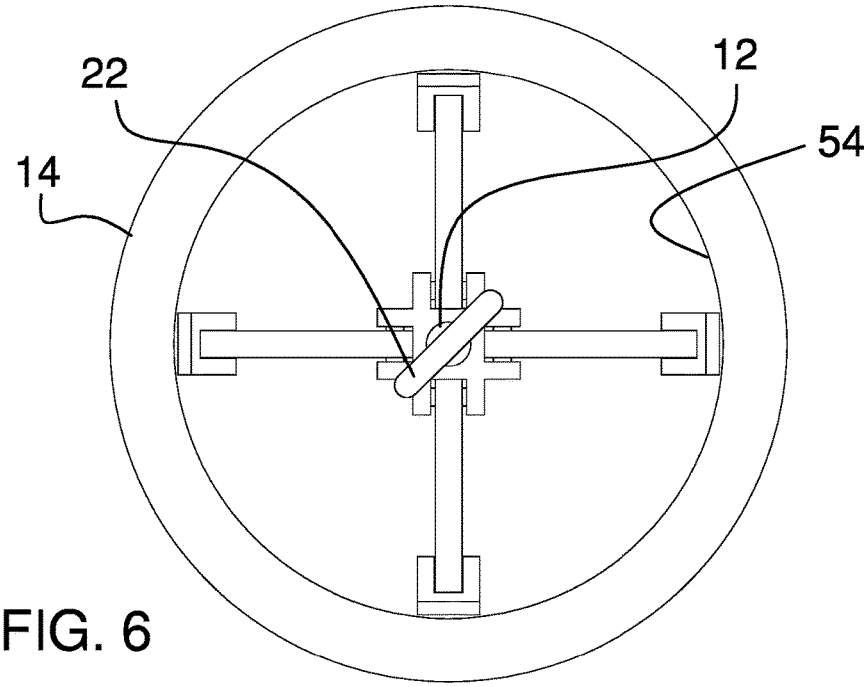
FIG. 6 is a perspective in-use view of an embodiment of the disclosure showing a tubular pipe being lifted.
Figure 7:
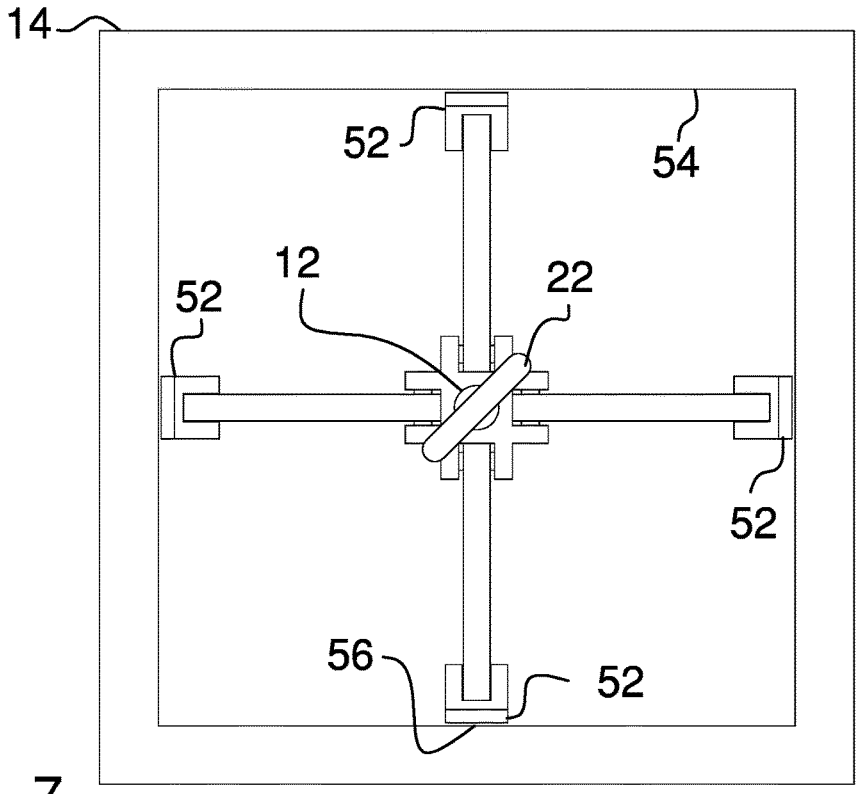
FIG. 7 is a perspective in-use view of an embodiment of the disclosure showing a rectilinear pipe being lifted.

A spring 62 is positioned around the eyebolt 12 and the spring 62 is positioned between the upper spreader 28 and the lower spreader 30. The spring 62 biases the upper spreader 28 to travel away from the lower spreader 30 when the nut 60 is loosened on the eyebolt 12. In this way the grips 52 are continually retained in the collinear orientation with respect to the eyebolt 12 when the nut 60 is loosened. The spring 62 is positioned between the top end 34 of the block 32 of the lower spreader 30 and the bottom end 36 of the block 32 of the upper spreader 28. As shown in FIG. 2, each of the grips 52 can be oriented at an angle with respect to the eyebolt 12 thereby facilitating the grips 52 to conform to a conical object. As shown in FIG. 7, each of the grips 52 can engage respective sides of a square tube or other similar, rectilinear pipe. Thus, the grips 52 facilitate tubular objects of varying geometries and shapes to be safely lifted without the use of slings or straps.

In use, the eyebolt 12 is inserted into the pipe 14 having the eyebolt 12 being oriented to be collinear with the pipe 14. The nut 60 is tightened on the eyebolt 12 until each of the grips 52 frictionally engages the interior surface 54 of the pipe 14. Thus, a lift can be attached to the eye 22 of the eyebolt 12 for lifting the pipe 14. The nut 60 is loosened on the eyebolt 12 when the pipe 14 has been lifted and transported thereby facilitating each of the grips 52 to disengage the interior surface 54 of the pipe 14. Thus, the eyebolt 12 can be removed from the pipe 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pipe lifting assembly being configured to frictionally engage an interior surface of a pipe thereby facilitating the pipe to be lifted, said assembly comprising:

an eyebolt being insertable into a pipe, said eyebolt having a first end, a second end and an outer surface extending therebetween, said outer surface being threaded, said eyebolt having a length of at least 11.0 inches, an eye of said eyebolt being positioned on said second end;

a cap being coupled to said first end of said eyebolt, said cap having an outside diameter being greater than an outside diameter of said eyebolt;

a pair of spreaders, each of said spreaders being slidably positioned around said eyebolt, each of said spreaders being positionable at a selected point along said eyebolt, said pair of spreaders including an upper spreader and a lower spreader, said lower spreader resting on said cap such that said lower spreader is inhibited from passing downwardly beyond said cap, said upper spreader being positioned between said lower spreader and said eye on said eyebolt, each of said spreaders comprising a block having a top end, a bottom end and an outer surface extending therebetween, said block having an aperture extending through said top and bottom ends, said eyebolt extending through said aperture such that said block is slidable on said eyebolt, said outer surface having a plurality of intersecting sides, each of said intersecting sides having a coupling being attached thereto, said bottom end of said block of said lower spreader abutting said cap;

a plurality of grips, each of said grips being pivotally coupled between each of said spreaders, each of said grips being oriented collinear with said eyebolt, each of said grips being spaceable a selected distance from said eyebolt when said upper spreader is moved upwardly or downwardly along said eyebolt, each of said grips frictionally engaging an interior surface of the pipe when said eyebolt is positioned in the pipe and said upper spreader is moved downwardly along said eyebolt wherein said grips are configured to facilitate the pipe to be lifted when said eyebolt is lifted, each of said grips disengaging the interior surface of the pipe when said upper spreader is moved upwardly along said eyebolt; and a nut threadably engaging said eyebolt such that said nut can rotatably travel upwardly and downwardly along said eyebolt, said nut being positioned between said upper spreader and said eye of said eyebolt, said nut urging said upper spreader toward said lower spreader when said nut is tightened on said eyebolt, said nut engaging said top end of said block of said upper spreader when said nut is tightened.

2. The assembly according to claim 1, wherein each of said spreaders includes a plurality of arms, each of said arms having a primary end and a secondary end, said primary end of each of said arms being pivotally coupled to a respective one of said couplings such that each of said arms is positionable at an upward or downward angle on said block.

3. The assembly according to claim 2, wherein each of said grips has a first surface and a second surface, said secondary end of each of said arms being pivotally coupled to said second surface of a respective one of said grips, said first surface of each of said grips comprising an abrasive material thereby enhancing said first surface of each of said grips to frictionally engage the interior surface of the pipe.

4. The assembly according to claim 1, further comprising a spring being positioned around said eyebolt, said spring being positioned between said upper spreader and said lower spreader, said spring biasing said upper spreader to travel away from said lower spreader when said nut is loosened on said eyebolt, said spring being positioned between said top end of said block of said lower spreader and said bottom end of said block of said upper spreader.

5. A pipe lifting assembly being configured to frictionally engage an interior surface of a pipe thereby facilitating the pipe to be lifted, said assembly comprising:

an eyebolt being insertable into a pipe, said eyebolt having a first end, a second end and an outer surface extending therebetween, said outer surface being threaded, said eyebolt having a length of at least 11.0 inches, an eye of said eyebolt being positioned on said second end;

a cap being coupled to said first end of said eyebolt, said cap having an outside diameter being greater than an outside diameter of said eyebolt;

a pair of spreaders, each of said spreaders being slidably positioned around said eyebolt, each of said spreaders being positionable at a selected point along said eyebolt, said pair of spreaders including an upper spreader and a lower spreader, said lower spreader resting on said cap such that said lower spreader is inhibited from passing downwardly beyond said cap, said upper spreader being positioned between said lower spreader and said eye on said eyebolt, each of said spreaders comprising:

a block having a top end, a bottom end and an outer surface extending therebetween, said block having an aperture extending through said top and bottom ends, said eyebolt extending through said aperture such that said block is slidable on said eyebolt, said outer surface having a plurality of intersecting sides, each of said intersecting sides having a coupling being attached thereto, said bottom end of said block of said lower spreader abutting said cap; and a plurality of arms, each of said arms having a primary end and a secondary end, said primary end of each of said arms being pivotally coupled to a respective one of said couplings such that each of said arms is positionable at an upward or downward angle on said block;

a plurality of grips, each of said grips being pivotally coupled between each of said spreaders, each of said grips being oriented collinear with said eyebolt, each of said grips being spaceable a selected distance from said eyebolt when said upper spreader is moved upwardly or downwardly along said eyebolt, each of said grips frictionally engaging an interior surface of the pipe when said eyebolt is positioned in the pipe and said upper spreader is moved downwardly along said eyebolt wherein said grips are configured to facilitate the pipe to be lifted when said eyebolt is lifted, each of said grips disengaging the interior surface of the pipe when said upper spreader is moved upwardly along said eyebolt, each of said grips having a first surface and a second surface, said secondary end of each of said arms being pivotally coupled to said second surface of a respective one of said grips, said first surface of each of said grips comprising an abrasive material thereby enhancing said first surface of each of said grips to frictionally engage the interior surface of the pipe;

a nut threadably engaging said eyebolt such that said nut can rotatably travel upwardly and downwardly along said eyebolt, said nut being positioned between said upper spreader and said eye of said eyebolt, said nut urging said upper spreader toward said lower spreader when said nut is tightened on said eyebolt, said nut engaging said top end of said block of said upper spreader when said nut is tightened; and a spring being positioned around said eyebolt, said spring being positioned between said upper spreader and said lower spreader, said spring biasing said upper spreader to travel away from said lower spreader when said nut is loosened on said eyebolt, said spring being positioned between said top end of said block of said lower spreader and said bottom end of said block of said upper spreader.

* * * * *